US006338555B1

(12) United States Patent
Hirose

(10) Patent No.: US 6,338,555 B1
(45) Date of Patent: Jan. 15, 2002

(54) HAND-HELD PRINTER

(75) Inventor: Takashi Hirose, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/141,723

(22) Filed: Aug. 27, 1998

(30) Foreign Application Priority Data

Aug. 27, 1997 (JP) ..... 9-246030

(51) Int. Cl.[7] ..... B41J 3/36; B41J 2/165
(52) U.S. Cl. ..... 347/109; 347/24
(58) Field of Search ..... 347/109, 163, 347/108, 19, 29, 3, 104; 358/497; 395/200.78; 400/88, 101

(56) References Cited

U.S. PATENT DOCUMENTS 4,377,741 A * 3/1983 Brekka et al. ..... 347/109

FOREIGN PATENT DOCUMENTS

| | | |
|---|---|---|
| JP | 2-2029 | 1/1990 |
| JP | 8-118614 | 5/1996 |
| JP | 8-156333 | 6/1996 |
| JP | 8-310051 | 11/1996 |
| JP | 9-314917 | 12/1997 |

* cited by examiner

*Primary Examiner*—John Barlow
*Assistant Examiner*—Charles W. Stewart, Jr.
(74) *Attorney, Agent, or Firm*—Foley & Lardner

(57) ABSTRACT

A hand-held printer and a method thereof has an ink jet head with a plurality of aligned ink nozzles, a device for moving the ink jet head in the orthogonal direction to the aligned direction of the plurality of ink nozzles, a printer case that covers a movable range of the ink jet head and has an opening on the side facing the plurality of ink nozzles, and a handle provided on the printer case. The method for printing one print line using a hand-held printer with a handle includes the steps of: receiving print data corresponding to one print line and discharging ink from a plurality of ink nozzles aligned on an ink jet head of the hand-held printer while moving the ink jet head in the orthogonal direction to the aligned direction of the plurality of ink nozzles according to the print data.

4 Claims, 5 Drawing Sheets

HAND-HELD PRINTER

FIELD OF THE INVENTION

This invention relates to a hand-held printer and relates to a method for printing one print line at a time using a hand-held printer.

BACKGROUND OF THE INVENTION

A thermal-transfer type handy printer that printing is conducted by moving the printing head by hand has been proposed (for example, Japanese patent application laid-open No. 2-2029 (1990)). In such a conventional hand-held printer, printing is conducted by moving the printer in a certain direction and thereby forwarding a print film while pressing the thermal head against the surface of a paper or an article to be printed.

Thus, in the conventional hand-held printer, the thermal head needs to be pressed through the print film against a print surface with a relatively high pressure because it employs the thermal transfer system. However, it is difficult to keep the pressure constant. Further, it is very difficult to keep the moving speed constant because the printing head needs to be moved in a certain direction by hand. Therefore, accuracy or concentration in printing cannot be stabilized.

SUMMARY OF THE INVENTION

Accordingly, it is an object of the invention to provide a hand-held printer that can give enhanced printing quality without requiring high pressure.

It is a further object of the invention to provide a hand-held printer that can stably provide a single high-quality printer line.

It is a further object of the invention to provide a method for printing one print line by using a hand-held printer that can give enhanced printing quality without requiring high pressure.

According to the invention, a hand-held printer, comprises:

an ink jet head with a plurality of aligned ink nozzles;

means for moving the ink jet head in the orthogonal direction to the aligned direction of the plurality of ink nozzles;

a printer case that covers a movable range of ink jet head and has an opening on the side facing the plurality of ink nozzles; and a handle provided on the printer case.

According to another aspect of the invention, a hand-held printer, comprises:

a printer head and a holder for holding the printer head;

wherein the printer head comprises an ink jet head with a plurality of aligned ink nozzles, means for moving the ink jet head in the orthogonal direction to the aligned direction of the plurality of ink nozzles, a printer case that covers a movable range of the ink jet head and has an opening on the side of the plurality of ink nozzles, and a handle provided on the printer case, and the holder comprises means for receiving the printer head, and means for covering the plurality of ink nozzles of the ink jet head when the printer is received into the receiving means.

According to another aspect of the invention, a method for printing one print line by using a hand-held printer with a handle, comprises the steps of:

receiving print data corresponding to one print line; and discharging ink from a plurality of aligned ink nozzles on an ink jet head of the hand-held printer while moving the ink jet head in the orthogonal direction to the aligned direction of the plurality of ink nozzles according to the print data.

BRIEF DESCRIPTION OF THE DRAWINGS

The invention will be explained in more detail in conjunction with the appended drawings, wherein.

DESCRIPTION OF THE PREFERRED EMBODIMENTS

Figure 1:
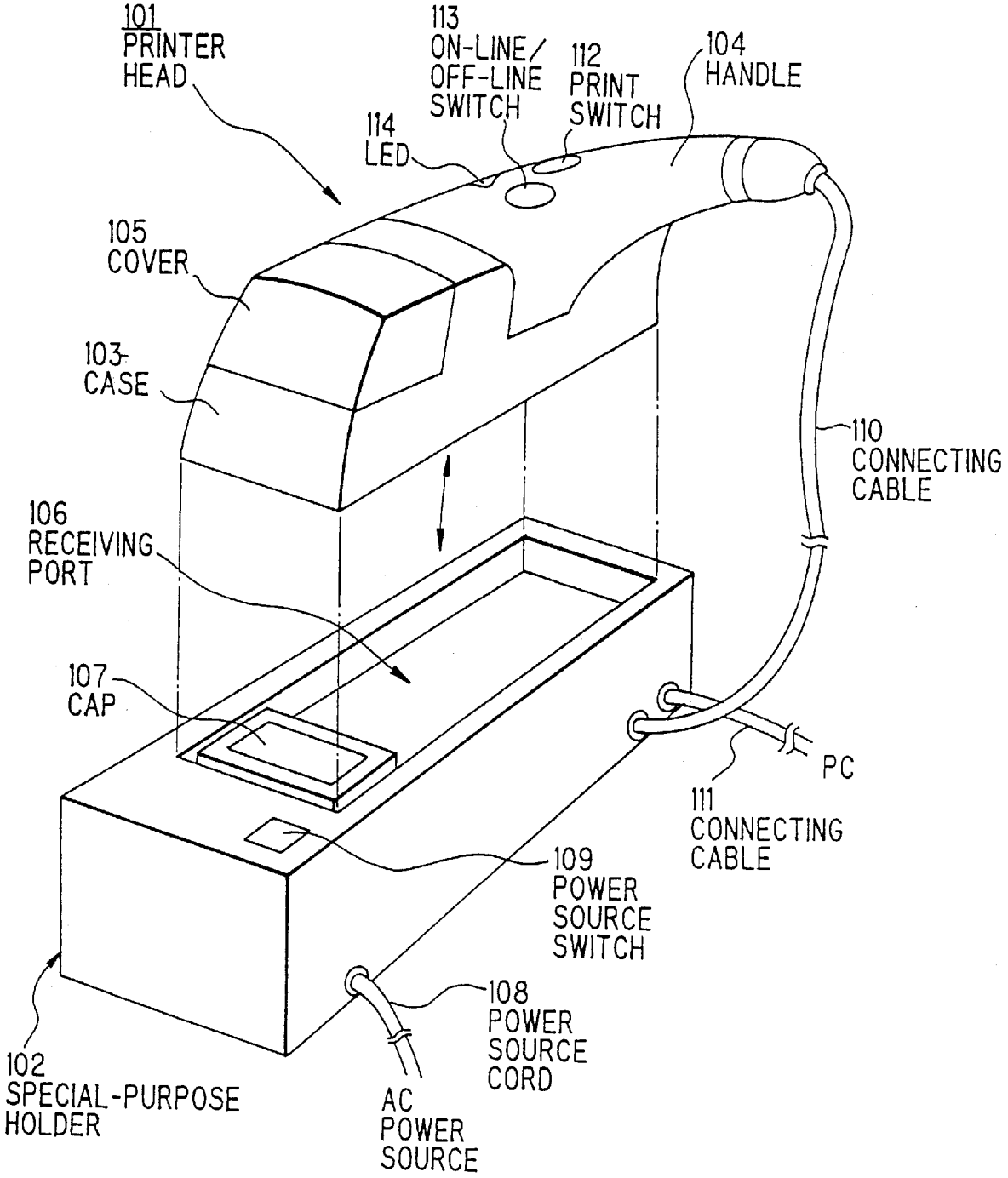
FIG. 1 is a perspective view showing a hand-held printer in a preferred embodiment according to the invention.

A hand-held printer in the preferred embodiment will be explained in FIG. 1. As shown, the hand-held printer comprises a print head 101 and a special-purpose holder 102. The printer head 101 has a case 103 with a cross section elongated in one direction, in which means for printing, e.g., an ink jet head, which is explained later, is contained. A handle 104, by which a user can hold the printer head 101 by one hand, is provided on the middle upper part of the case 103. Also, there is provided a detachable cover 105 for changing an ink cartridge on one upper end of the case 103.

On the upper part of the holder 102, receiving part 106 to receive the printer head is provided. On one end of the receiving part 106, there is provided a cap 107, explained later, for preventing an ink jet head 203 from drying when it is not used. The holder 102 is powered through an AC power source cord 108, and the power source is turned on/off by a power source switch 109. Also, the printer head 101 is connected through a connecting cable 110 to the holder 102, and the holder 102 is connected through a connecting cable 111 to the printer port of a personal computer (PC). The handle 104 is provided with a print switch 112, an on-line/off-line switch 113 and LED 114.

Figure 2:
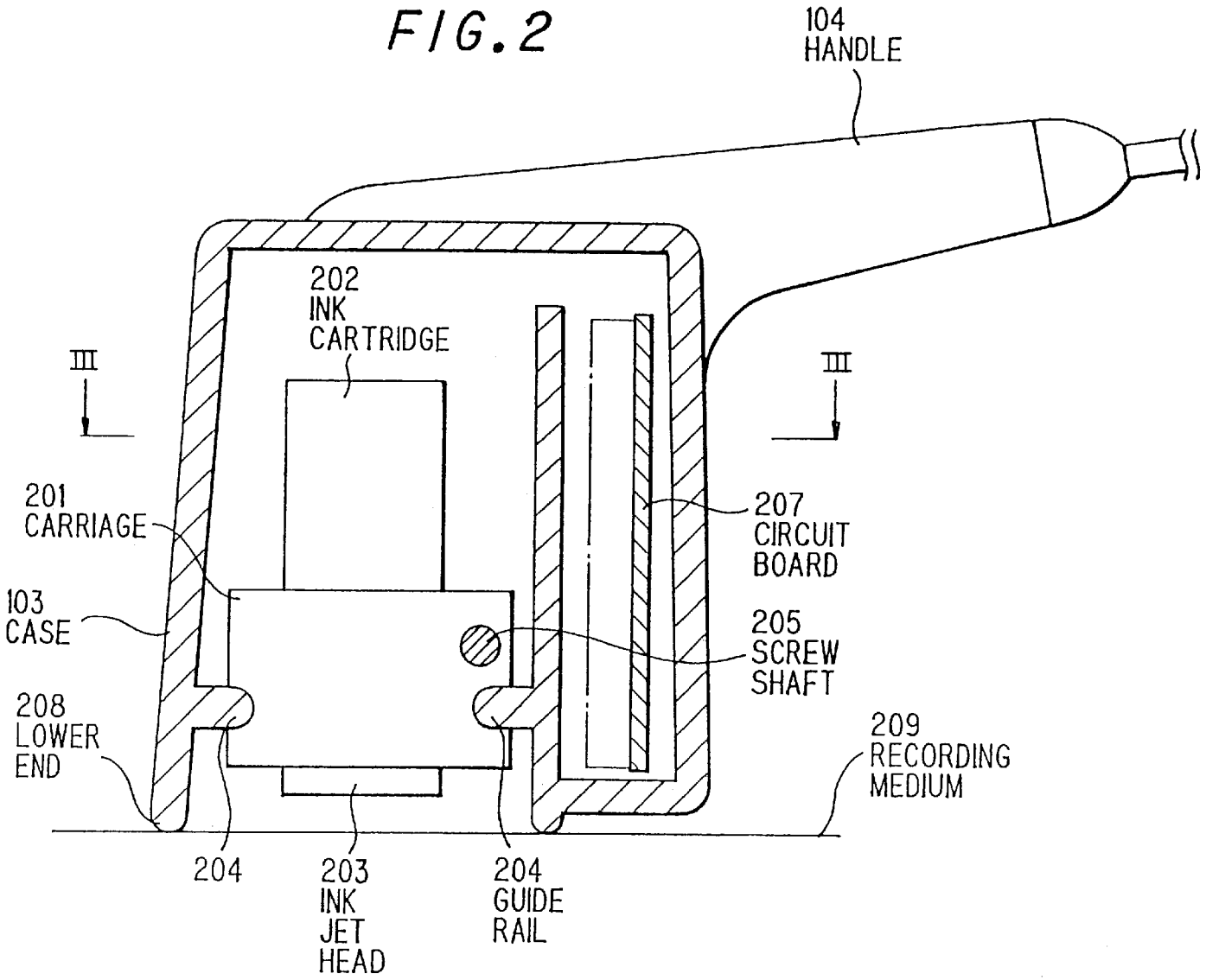
FIG. 2 is a partial cross sectional view of the hand-held printer in FIG. 1.
Figure 3:
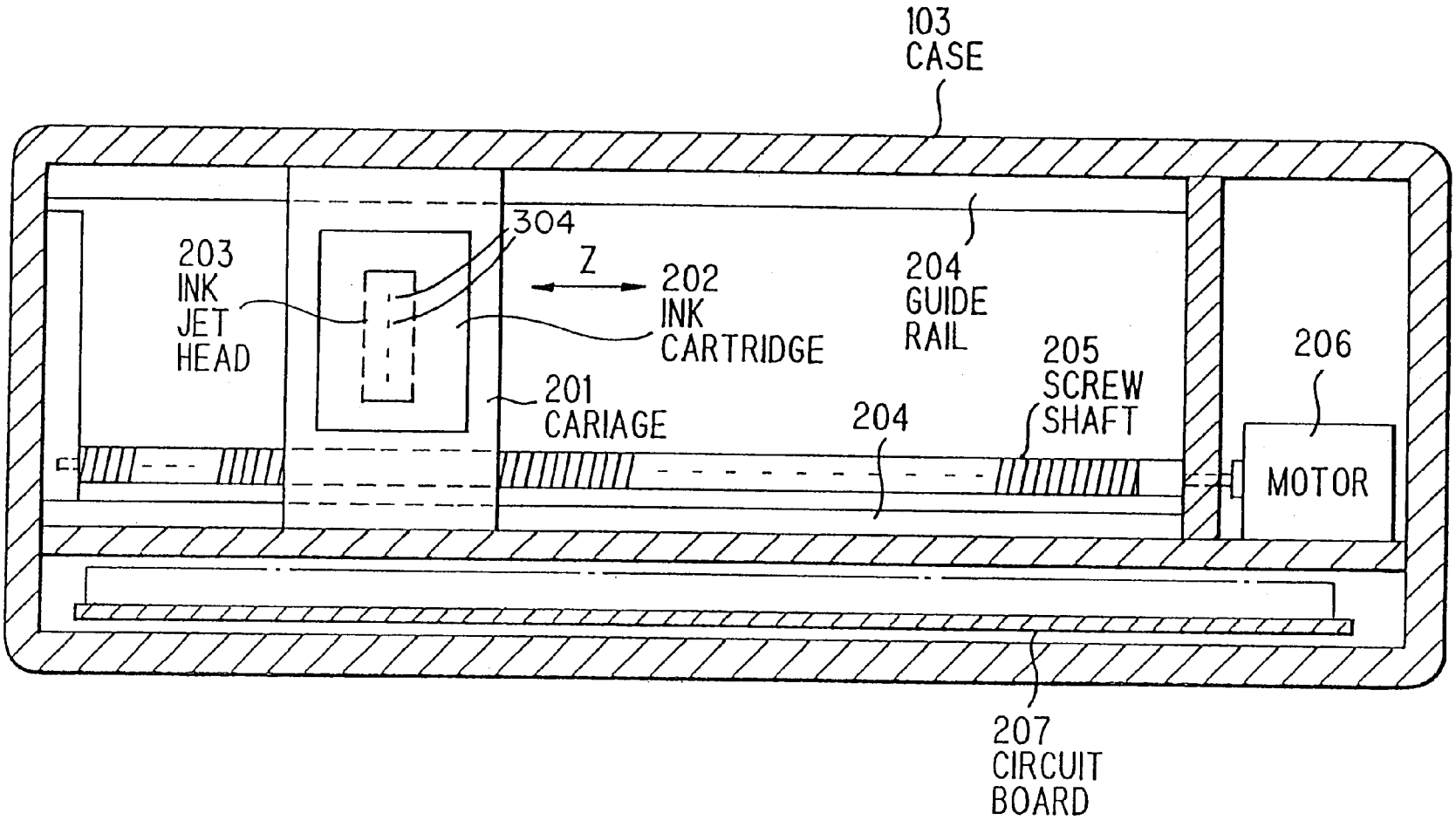
FIG. 3 is a longitudinal sectional view taken along line III—III of FIG. 2.

FIG. 2 is a schematic cross sectional view of the hand-held printer and FIG. 3 is a longitudinal sectional view taken along line III—III of FIG. 2. In the case 103 of the printer head 101, a carriage 201 is disposed so that it can move in the longitudinal direction (Z direction) of the case 103. An ink cartridge 202 and an ink jet head 203 are fixed to the carriage 201. The ink cartridge 202 is detachably fixed to the upper part of the carriage 201 with its ink-supplying port directed downward. The ink jet head 203 is fixed facing downward in the direction of the opening of the case 103. Meanwhile, such a one-body type ink cartridge that the ink jet head 203 is attached to the lower end of the ink cartridge 202 may be also used.

On the front and back sides of the carriage 201, grooves extending in the horizontal direction (Z direction) are provided. These grooves are engaged with guide rails 204 formed on the inside wall of the case 103. Thereby, the carriage 201 being supported is movable in the Z direction. The carriage 201 is provided with a through-hole corresponding to a screw shaft 205. By rotating the screw shaft 205 by a motor, the carriage 201 can be traveled in the Z direction. As shown in FIG. 3, several ink discharge nozzles 304 on the ink jet head 203 are placed in the orthogonal direction to the moving direction (Z direction) of the carriage 201.

Also, a circuit board 207 for processing a control signal and print data to be input through the holder 102 from PC and controlling the ink jet head 203 and the motor 206 is disposed in the case 103. Meanwhile, the circuit board 207 is electrically connected through a flexible wiring board (not shown) with the ink jet head 203.

Further, lower ends 208 of the case 103 extend lower than the ink discharge nozzles 304 of the ink jet head 203. Thereby, the ink discharge nozzles 304 can be located with a certain distance from a recording medium 209, such as a paper. Namely, its user only has to put the printer head 101 on a desired position of the recording medium 209 while holding the handle 104.

Figure 4:
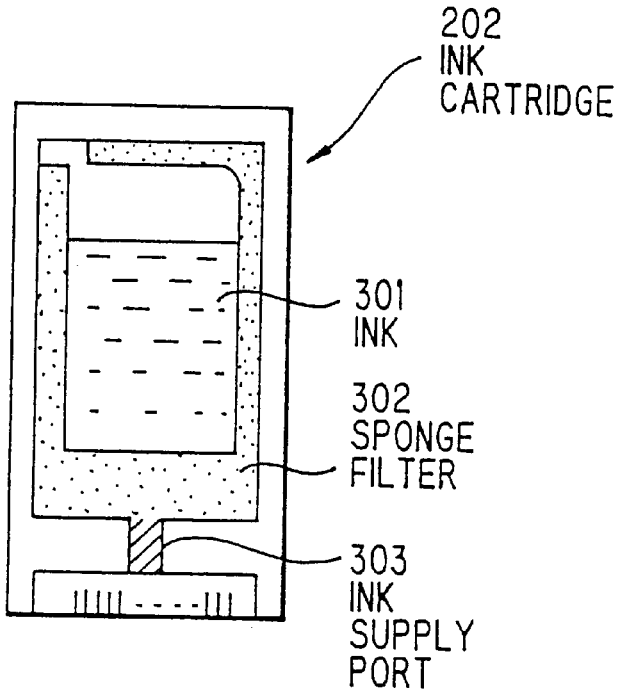
FIG. 4 is a cross sectional view of an ink cartridge in FIG. 2.

FIG. 4 is a schematic cross sectional view showing an example of the ink cartridge 202. Ink 301 in the cartridge 201 is constantly supplied through a sponge filter 302 disposed inside the cartridge 201 to an ink supply port 303.

Figure 5:
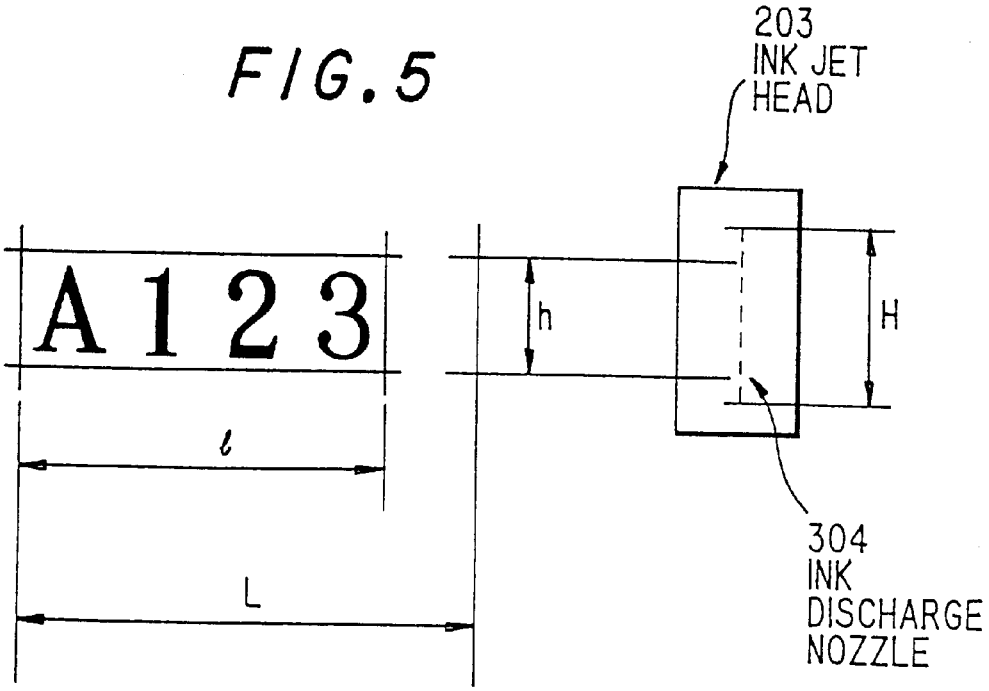
FIG. 5 is an illustration showing a print-possible range of the hand-held printer in the embodiment.

FIG. 5 is an illustration explaining a print-possible range of the ink jet head of the hand-held printer in the embodiment. When the ink jet head 203 has an lineup length of H for the ink supply nozzles 304 and a maximum travel length of L in the Z direction, the height, h of one print line, e.g., "A123", is set to be less than H, and the print-possible length, l thereof is also set to be less than the maximum travel length L.

Figure 6:
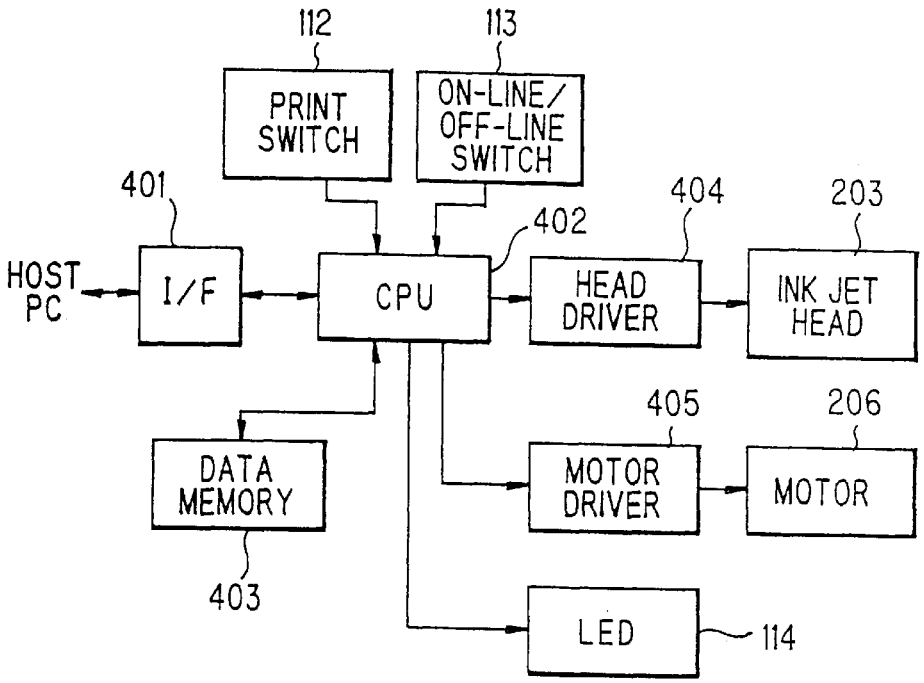
FIG. 6 is a circuit diagram showing the hand-held printer in the embodiment.

FIG. 6 is a schematic circuit diagram showing the hand-held printer in the embodiment. The printer head 101 transmits a control signal through an interface circuit 401 to a host PC and receives a print control signal and print data from the host PC. A processor (CPU) 402 controls a control signal sequence for data reception and stores the received print data in a data memory 403. The stored print data are read out by the user's operation of a print switch 112, and then a head driver 404 drives the ink jet head 203 according to the control of the processor 402 and a motor driver 405 simultaneously drives the motor 206. Thereby, the ink jet head 203 discharges ink dots from the ink discharge nozzles 304 while moving in the Z direction. As a result, one-line printing is performed as shown in FIG. 5. The interface circuit 401, processor 402, a data memory 403, head driver 404 and motor driver 405 can be installed in the circuit board 207 disposed in the case 103.

Figure 7:
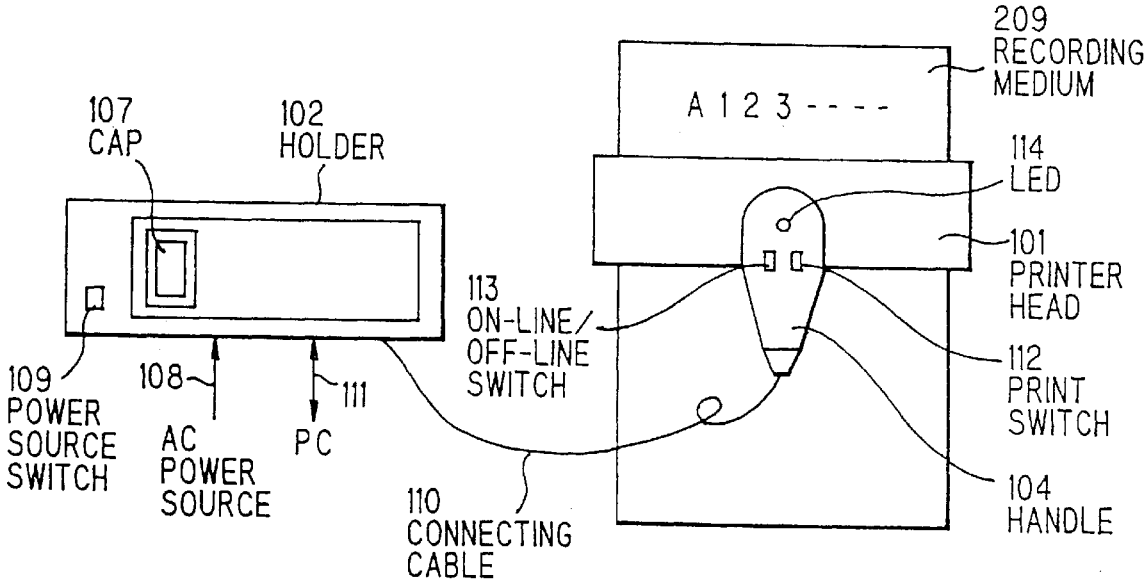
FIG. 7 is an illustration for explaining the operation of the hand-held printer in the embodiment.

FIG. 7 is an illustration explaining the operation of the hand-held printer in the embodiment. First, by switching on the power source switch 109, the processor 402 initializes the data memory 403, etc. and turns on LED 114 when data reception from the host PC is enabled. Then, when one-line print data received from the host PC are stored in the data memory 403, the processor 402 notifies the completion of data reception to the host PC and controls LED 114 to turn on and off. After confirming the turning on and off of LED 114, its user put the printer head 101 on a desired position of the recording medium 209 while holding the handle 104 and presses down the print switch 112. Thereby, the ink jet head 203 discharges ink dots from the ink discharge nozzles 304 while moving in the Z direction. As a result, one-line printing is performed. To stop the printing, for example, after pressing down the on-line/off-line switch 113, the user has only to press down the print switch 112.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching here is set forth.

What is claimed is:

1. A hand-held printer comprising:

a printer head having an ink jet head with a plurality of aligned ink nozzles;

a holder for holding said printer head, said holder having means for receiving said printer head;

means for moving said ink jet head orthogonal to an alignment direction of said plurality of ink nozzles;

a printer case that covers a movable range of said ink jet head and has an opening on a side facing said plurality of ink nozzles;

a handle provided on said printer case; and means for covering said plurality of ink nozzles of said ink jet head when said printer head is received into said receiving means.

2. A hand-held printer according to claim 1, wherein said printer case has an end that extends outwardly beyond said plurality of ink nozzles on the side of said opening.

3. A hand-held printer according to claim 1, further comprising:

an external interface for communicating input and output signals; and means for controlling said ink jet head and said moving means to conduct printing according to the input signal.

4. A hand-held printer according to claim 1, wherein said handle is provided with a print start switch.

* * * * *